US005241738A

United States Patent [19]

Colvin

[11] Patent Number: 5,241,738

[45] Date of Patent: Sep. 7, 1993

[54] METHOD OF MAKING A COMPOSITE CASTING

[75] Inventor: Gregory N. Colvin, Muskegon, Mich.

[73] Assignee: Howmet Corporation, Whitehall, Mich.

[21] Appl. No.: 2,104

[22] Filed: Jan. 8, 1993

Related U.S. Application Data

[63] Continuation of Ser. No. 672,945, Mar. 21, 1991, abandoned.

[51] Int. Cl.[5] ..... B22D 19/02; B23P 17/00

[52] U.S. Cl. ..... 29/526.2; 29/527.5; 164/98; 164/112

[58] Field of Search ..... 29/526.2, 526.3, 527.5; 164/98, 112, 332, 334

[56] References Cited

U.S. PATENT DOCUMENTS

| | | | |
|---|---|---|---|
| 2,084,247 | 6/1937 | Dockray et al. | 249/91 X |
| 2,161,116 | 6/1939 | White | 164/112 X |
| 2,745,437 | 5/1956 | Comstock, III | 138/64 |
| 3,596,703 | 8/1971 | Bishop et al. . | |
| 3,659,645 | 5/1972 | Rose . | |
| 3,819,145 | 6/1974 | Huber et al. | 249/205 |
| 4,008,052 | 2/1977 | Vishnevsky et al. . | |
| 4,487,246 | 12/1984 | Frasier . | |
| 4,572,270 | 2/1986 | Funatani et al. | 164/97 |
| 4,811,778 | 3/1989 | Allen et al. . | |
| 4,889,177 | 12/1989 | Charbonnier et al. | 164/97 |

FOREIGN PATENT DOCUMENTS

| | | | |
|---|---|---|---|
| 58-61959 | 4/1983 | Japan | 164/98 |
| 58-209464 | 12/1983 | Japan | 164/112 |
| 59-82157 | 5/1984 | Japan | 164/98 |
| 60-158968 | 8/1985 | Japan | 164/112 |
| 16286 | of 1913 | United Kingdom | 164/12 |
| 2098112A | 11/1982 | United Kingdom | 164/98 |

*Primary Examiner*—J. Reed Batten, Jr.

*Attorney, Agent, or Firm*—Flynn, Thiel, Boutell & Tanis

[57] ABSTRACT

A casting mold includes a melt-receiving mold cavity having a preformed metallic or intermetallic insert suspended therein by at least one elongated, slender suspension member fixed at one end to the insert and at another end to the mold. A melt of metallic or intermetallic material is introduced into the mold cavity about the suspended insert and the suspension member and is solidified to form a composite casting The casting is subjected to elevated temperature/elevated isostatic gas pressure conditions wherein the interface between the suspension member and the cast melt is effective to inhibit gas penetration between the insert and cast melt, thereby allowing a sound, void-free, contamination-free metallurgical bond to be produced between the insert and the cast melt.

25 Claims, 3 Drawing Sheets

METHOD OF MAKING A COMPOSITE CASTING

This application is a continuation of U.S. application Ser. No. 07/672,945, filed Mar. 21, 1991, and now abandoned.

FIELD OF THE INVENTION

The present invention relates to a method of making a composite casting, as well as casting produced thereby, having a preformed metallic or intermetallic insert, such as, for example, a reinforcement insert comprising a metal matrix composite, bonded in a preselected position therein.

BACKGROUND OF THE INVENTION

Components for aerospace, automotive and like service applications have been subjected to the ever increasing demand for improvement in one or more mechanical properties, such as tensile strength, ductility, fatigue life, resistance to impact damage, etc. while at the same time maintaining or reducing the weight of the component. To this end, the Charbonnier et. al. U.S. Pat. No. 4,889,177 describes a method of making a composite casting wherein a molten lightweight alloy, such as aluminum or magnesium, is countergravity cast into a gas permeable sand mold having a fibrous insert of high strength ceramic fibers positioned therein by metallic seats so as to be incorporated into the casting upon solidification of the molten alloy.

The Funatani et. al. U.S. Pat. No. 4,572,270 describes a method of making a composite casting to this same end wherein a mass of high strength reinforcing material, such as ceramic fibers, whiskers, or powder, is incorporated into a lightweight metal matrix (e.g., aluminum or magnesium) that is die cast around the reinforcing mass in a pressure chamber.

A technique commonly referred to as bicasting has been employed in attempts to improve one or more mechanical properties of superalloy castings for use as aerospace components. Bicasting involves pouring molten metal into a mold cavity in which a preformed insert is positioned in a manner to augment one or more mechanical properties in a particular direction(s). The molten metal surrounds the insert and, upon solidification, yields a composite casting comprising the insert embedded in and hopefully soundly bonded with the cast metal without contamination therebetween. However, as described in U.S. Pat. No. 4,008,052 attempts at practicing the bicasting process have experienced difficulty in consistently achieving a sound metallurgical bond between the insert and the metal cast therearound without bond contamination. Moreover, difficulty has been experienced in positioning the insert in the mold cavity and thus the final composite casting within required location tolerances. The inability to achieve on a reliable and reproducible basis a sound, contamination-free bond between the insert and the cast metal has significantly limited use of bicast components in applications, such as aerospace components, where reliability of the component in service is paramount.

It is an object of the invention to provide an improved bicasting type of process for making a composite casting wherein a sound, contamination-free metallurgical bond is reliably and reproducibly produced between the preformed insert and the cast metal therearound.

It is another object of the invention to provide an improved bicasting type of process for making a composite casting wherein positioning of the preformed insert in the mold cavity and thus in the final composite casting within required location tolerances is achievable.

SUMMARY OF THE INVENTION

The present invention involves a method of making a composite casting, as well as a casting produced thereby, wherein a casting mold is provided having a melt-receiving mold cavity and a preformed metallic or intermetallic insert is suspended in a predetermined position in the mold cavity by at least one elongated, slender suspension member fixed at one end to the insert and fixed at another end to the mold. A melt is introduced into the mold cavity about the suspended insert and about at least a portion of the suspension member and is solidified to provide a composite casting. The method preferably involves the further step of subjecting the casting to elevated temperature and isostatic gas pressure conditions wherein the interface between the suspension member and the cast melt therearound is effective to inhibit gas penetration between the preformed insert and the cast melt therearound so as to produce a sound, void-free, contamination-free metallurgical bond between the insert and the cast melt.

In one embodiment of the invention, the suspension member and cast melt are at least partially metallurgically bonded to aid in inhibiting penetration of the isostatic gas pressure between the preformed insert and the cast melt therearound. Preferably, the suspension member is partially melted by the melt cast into the mold to enhance such metallurgical bonding. The suspension member may include a melting point depressant to facilitate melting thereof.

In another embodiment of the invention, the end of the suspension member fixed to the mold is received in an ingate passage of the mold that supplies the melt to the mold cavity and is fixed in position in a locating depression or aperture therein so as to locate the insert in the preselected position in the mold cavity. Alternately or in addition, the end of the same or different suspension member is received in a riser passage of the mold and is fixed in position therein so as to locate the insert in the preselected position.

In still another embodiment of the invention, the preformed insert comprises a metallic or intermetallic material which may include reinforcements, such as reinforcing filaments, particulates, etc. therein. An exemplary preformed insert comprises a metal matrix composite. The metallic or intermetallic material of the insert may correspond substantially in composition to the melt introduced into the mold cavity.

DETAILED DESCRIPTION OF THE INVENTION

Figure 1:
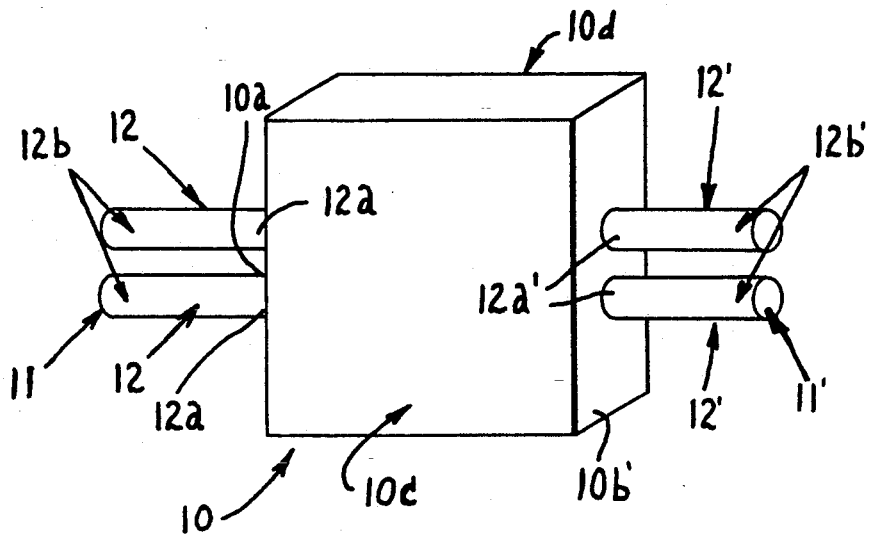
FIG. 1 is a schematic perspective view of a preformed insert having a pair of axially extending suspension members (i.e. pins) fixed to opposite ends thereof.

Referring to FIG. 1, a preformed insert 10 is shown having a first and second pairs 11, 11' of elongated, slender axially extending suspension members 12, 12' affixed to opposite axial ends 10*a*, 10*b* of the preform in accordance with one embodiment of the invention. In the particular embodiment shown, each suspension member 12, 12' comprises an elongated, lender cylindrical pin having one end 12*a*,12*a*' welded or otherwise affixed to the preform 10 and another opposite end 12*b*,12*b*' that ultimately will be affixed to the casting mold in a manner to be described below.

The preform 10 may comprise a metallic or intermetallic material that is preformed by conventional fabrication operations, such as casting, powder metallurgy, plasma spraying, forging, etc., in the desired shape for the composite casting to be made. The preformed insert 10 may comprise a metallic or intermetallic material having a composition similar to or different from that of the melt to be cast therearound. The preformed insert 10 may include reinforcements, such as reinforcing particulates, filaments, and the like, therein. For example, the preformed insert 10 may comprise a metal matrix composite insert comprising a metallic or intermetallic matrix reinforced with suitable reinforcing filaments or particulates. The metal matrix composite may be sheathed with a material compatible with the melt to be cast so as to avoid unwanted reaction between the reinforcement and the cast melt.

The suspension members or pins 12,12' preferably comprise a metallic or intermetallic material corresponding substantially in composition to the composition of the cast melt so as not to degrade the properties of the bicasting ultimately produced. Typically, the suspension pins 12,12' shown in FIG. 1 are formed by severing small diameter wire or rod to appropriate lengths for suspending the insert 10 in the casting mold cavity 30 in a manner to be described hereinbelow.

The slender suspension members 12,12' are preferably provided with a cross-section that is substantially smaller than the cross-section of the relatively bulky preformed insert 10 so as to provide a reduced-area interface between each suspension member 12,12' and the melt cast therearound (as compared to the interface area between the preformed insert 10 and melt cast therearound) effective to inhibit gas penetration to the interface between the preformed insert and the cast melt during a subsequent hot isostatic pressing operation to be described hereinbelow. For example, the ratio of the cross-section of each suspension member 12,12' to the cross-section of the preformed insert 10 typically is in the range of 0.002 to 0.1. A particular ratio of the cross-section of each suspension member 12,12' to that of the preformed insert 10 of about 1/100 has been used in practicing the invention although the invention is not limited to any particular ratio. Suspension members 12, 12' having a diameter in the range of about 0.010 to about 0.250 inch are useful in practicing the invention to this end.

Figure 2:
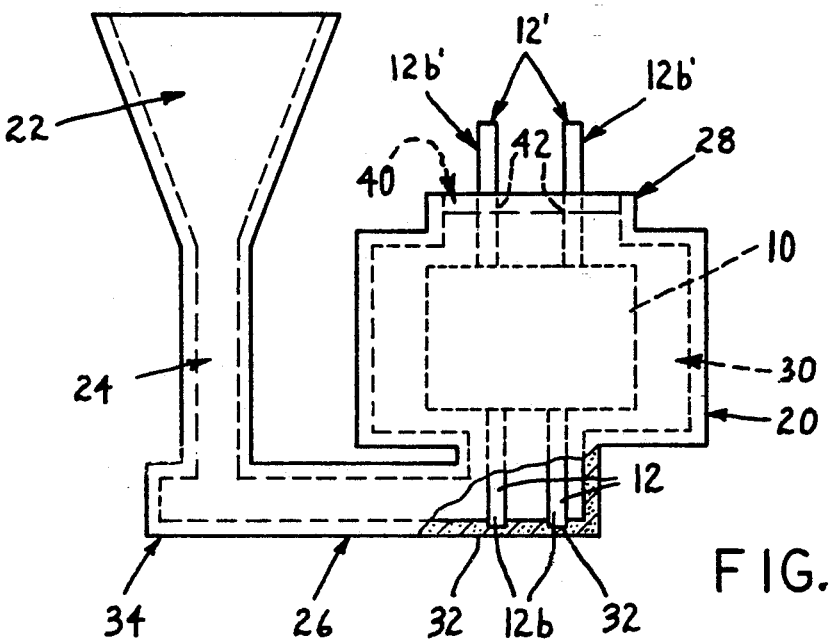
FIG. 2 is a schematic side elevational view of the ceramic shell mold with a preformed insert of slightly different dimensions than shown in FIG. 1 positioned in the mold cavity thereof after the wax pattern is selectively removed from the mold.

Referring now to FIG. 2, the preformed insert 10 having the suspension members 12,12' fixed (e.g., welded) to the opposite ends 10*a*, 10*b* is shown positioned in a ceramic investment casting shell mold 20. The shell mold 20 includes a frusto-conical funnel 22 into which a melt is poured from a suitable source, such as a ladle or crucible, a down sprue 24, and a laterally extending ingate or channel 26 that receives the melt from the down sprue 24. The ingate 26 is communicated to the mold cavity 30 so as to supply the melt thereto to fill the mold cavity 30 and the riser 28 thereabove. The shell mold 20 is fabricated in accordance with conventional shell mold practice wherein a fugitive (e.g., wax) pattern assembly in the configuration of the desired funnel 22, down sprue 24, ingate 26, riser 28 and mold cavity 30 is dipped in a ceramic slurry, stuccoed or sanded with dry ceramic particulates, and then dried in repeated fashion to build up the shell mold 20 thereon. The pattern assembly is selectively removed from the shell mold 20 in conventional manner, such as by melting, dissolving or vaporization of the pattern. Thereafter, the shell mold 20 is fired at elevated temperature to develop proper mold strength for casting.

In accordance with the present invention, the preformed insert 10 is suspended to required location tolerances in the mold cavity 30 by the slender suspension members or pins 12,12' which are affixed at the pin ends 12*a*,12*a*' to the insert 10 as described above and which are fixed at the other opposite pin ends 12*b*,12*b*' to the mold 20 as will now be described.

In particular, the preformed insert 10 having the suspension members 12,12' affixed thereon is inserted into the mold cavity 30 of the fired mold 20 through the open riser 28 until the ends 12*b* of the lower suspension members 12 are received in suitably shaped locating depressions 32 formed in the bottom wall 34 of the mold ingate 26 as shown in FIG. 2. The locating depressions 32 typically are formed in the bottom mold wall 34 by providing suitable projections (not shown) on the aforementioned wax pattern assembly and then investing the pattern assembly in ceramic as described above. As those skilled in the art will appreciate, the projections on the wax pattern will form corresponding depressions in the bottom mold wall 34 invested thereon. The projections are formed accurately at predetermined locations on the wax pattern so as to yield depressions 32 located within required location tolerances in the bottom mold wall 34 to receive the ends 12*b* of the lower suspension members 12 as shown and fix them in position on the mold. The lower ends 12*b* may optionally be adhered in the depressions 32 by suitable ceramic adhesive. In lieu of depressions 32 in the bottom mold wall 34, through-holes or apertures (not shown) may be formed therein for receiving the ends 12*b* of the suspension member 12 and fixing them in desired position. The ends 12*b* optionally can be adhered in each through-hole by suitable ceramic adhesive, which would prevent melt leakage.

The upper suspension members or pins 12' are fixed on a ceramic mold locating plate 40 which is received and glued by ceramic adhesive in the mold riser 28 as shown in FIG. 2 and thus is considered part of the mold 20. The locating plate 40 includes a pair of locating apertures 42 in which the ends 12*b*' of the upper suspension members 12' are received and fixed in desired position. The ends 12*b*' can be optionally adhered in the apertures 42 by suitable ceramic adhesive. Typically, in assembling the insert 10 and the mold 20, the insert 10 is inserted into the mold cavity 30 until the lower suspension members 12 are received and located in the depressions 32 and then the locating plate 40 is fixed in the riser 28 with the upper suspension members 12' received and fixed in position in the locating apertures 42.

Fixation of the lower suspension members 12 in the depressions 32 and fixation of the upper suspension members 12' in the apertures 42 locates the preformed insert 10 within required location tolerances in the mold cavity 30 spaced from the interior walls thereof. The suspension members 12,12' exhibit sufficient strength and are provided in appropriate orientation and numbers to support the insert 10 in the required position in the mold cavity 30 despite the flow of melt into the mold cavity during casting.

After the preformed insert 10 is positioned in the mold cavity 30, a melt of a selected metallic or intermetallic material is poured from a ladle or crucible (not shown) under vacuum into the mold funnel 22 and travels through the down sprue 24 and ingate 26 into the mold cavity 30 and riser 28. The preformed insert 10 and at least a portion of the suspension members 12,12' are thereby surrounded by the melt. Upon solidification of the melt in the mold 20, a composite casting 50 is produced and includes the preformed insert 10 and at least a portion of the suspension members 12,12' embedded in the cast melt 52, see FIG. 3. Casting and solidification of the melt in-situ about the insert 10 and the suspension members 12,12' in conjunction with the relatively small cross-section of the slender suspension members 12,12' provide intimate interfaces F between the suspension members 12,12' and the cast melt 52 that have been found to inhibit gas penetration therebetween in a subsequent hot isostatic pressing operation. Preferably, at least partial metallurgical bonding is achieved between the suspension members 12,12' and the cast melt 52 to this end; i.e., to inhibit gas penetration during hot isostatic pressing. Metallurgical bonding between the suspension members 12,12' and the cast melt is enhanced if the suspension members 12,12' are partially melted by the melt prior to solidification thereof. A melting point depressant may be provided on the suspension members 12,12' to this end.

Figure 3:
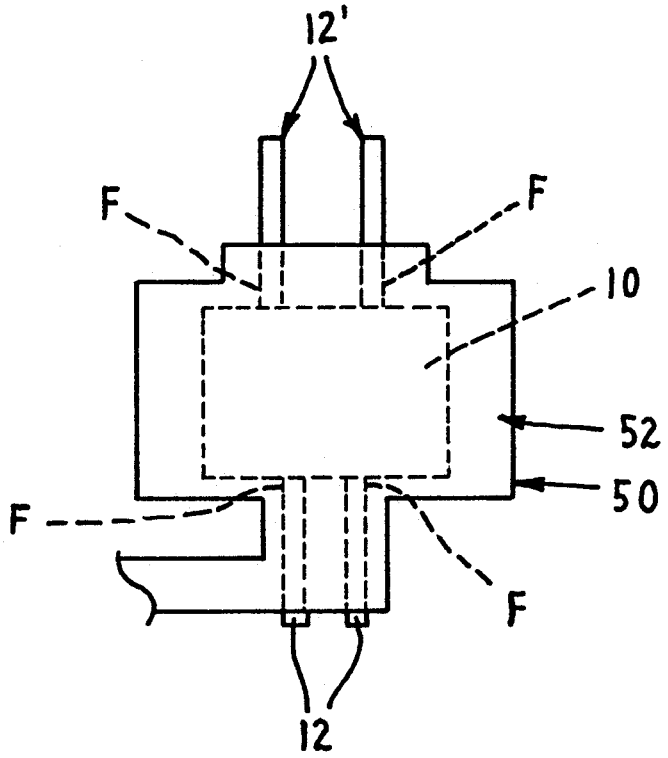
FIG. 3 is an elevational view of the composite casting made in accordance with one embodiment of the invention.

Following solidification of the melt, the mold 20 including mold plate 40 are removed by conventional techniques from the composite casting 50 comprising the preformed insert 10 embedded in the cast melt 52 with the suspension members 12,12' extending to exterior surfaces of the cast melt as shown in FIG. 3.

The composite casting is then subjected to a hot isostatic pressing operation under elevated temperature/elevated isostatic gas pressure/time conditions effective to close any voids which may exist between the preformed insert 10 and the cast melt 52 thereabout as well as to insure that a complete, sound metallurgical bond is achieved between the insert 10 and the surrounding cast melt 52. Moreover, the conditions of hot isostatic pressing typically are effective to completely, soundly metallurgically bond the suspension members 12,12' and the surrounding cast melt 52. The particular elevated temperature/elevated pressure/time conditions used will be tailored to the particular melt composition employed, the insert material employed as well as the size of the composite casting produced.

The intimate interfaces F between the suspension members 12,12' and the cast melt 52 have been found to be effective in inhibiting penetration of the isostatic pressing gas, such as argon, to the interface between the insert 10 and the cast melt during the hot isostatic pressing operation. In effect, the insert 10 is embedded inside the cast melt 52 and communicates with the ambient atmosphere only via the reduced-area, intimate interfaces F between the suspension members 12,12' and the cast melt 52, which interfaces F are located externally of the interface between the insert 10 and the cast melt 52 as is apparent from FIG. 3. As the following examples will illustrate, a sound, void-free, contamination--free metallurgical bond is achieved between the insert 10 and the cast melt 52 when penetration of the isostatic pressing gas is effectively prevented in accordance with the invention.

The cast melt in the mold ingate 26 and the mold riser 28 can be removed from the composite casting 50 either prior to or after the hot isostatic pressing operation.

EXAMPLE 1

A ceramic shell mold 20 similar to that shown in FIG. 2 but having two separate plate-shaped mold cavities 30 was made in accordance with conventional shell mold practice. However, one of the mold cavities 30 had positioned therein a preformed Ti-6Al-4V plate insert 10 by the technique illustrated in FIG. 2. The preformed plate insert 10 measured 3 inches in width, 3 inches in vertical length, and 0.25 inch in thickness. The plate insert 10 was suspended in the mold cavity using first and second pairs of Ti-6Al-4V suspension pins 12, 12' of 0.060 inch diameter and 2 inches length TIG welded to opposite ends of the plate insert as shown in FIG. 2. The other ends of the suspension pins were fixed in position to the mold 20 in the manner also shown in FIG. 2. The other mold cavity 30 had no preformed insert therein.

A Ti-6Al-4V melt was cast under a vacuum of less than 10 microns into the mold preheated to 600° F. and solidified in each mold cavity. The plate-shaped castings were separated from the shell mold and identically hot isostatically pressed at 1650° F. and 15 ksi argon gas pressure for 2 hours. As shown in the Table below, the mechanical properties of the bicasting 50 (i.e., the Ti-6-Al-4V preformed plate embedded in the Ti-6Al-4V cast melt) and the monolithic casting (i.e., no preformed plate present) were essentially identical, indicating that a sound metallurgical bond was produced between the preformed plate insert 10 and the cast melt. None of the fractures observed during the mechanical property testing initiated or propagated through the bond region between the plate insert 10 and the cast melt. Metallographic examination of the bicasting confirmed that a sound bond had been produced in the bicasting.

| Mechanical Test Method | Material | UTS (ksi) | YS (ksi) | Reduction of Area (%) | Impact Energy (ft-lbs) |
|---|---|---|---|---|---|
| tensile | Monolithic | 125.1 | 113.6 | 17.2 | |
| | | 124.4 | 114.1 | 18.2 | |
| | | 124.8 | 114.3 | 11.6 | |
| | bicast | 117.8 | 110.5 | 28.6 | |
| | | 115.9 | 112.4 | 30.3 | |
| | | 121.6 | 110.5 | 17.2 | |
| charpy unnotched | monolithic | | | | 108 |
| | | | | | 112 |
| | bicast | | | | 115 |
| | | | | | 131 |
| | | | | | 110 |

EXAMPLE 2

A ceramic shell mold 20 similar to that shown in FIG. 2 but having two separate plate-shaped mold cavities 30 was made in accordance with conventional shell mold practice. However, one of the mold cavities 30 had positioned therein a preformed Ti-6Al-4V plate insert 10 by the technique illustrated in FIG. 2. The preformed plate insert measured 2 inches in width, 4 inches in vertical length, and 0.25 inches in width inch in thickness. The plate insert 10 was suspended in the mold cavity using first and second pairs of Ti-6Al-4V suspension pins 12,12' of 0.060 inch diameter and 2 inches length TIG welded to opposite ends of the plate insert as shown in FIG. 2. The other ends of the suspension pins were fixed in position to the mold 20 in the manner also shown in FIG. 2.

The other mold cavity 30 had a similar but longer preformed Ti-Al-4V plate insert positioned therein in a prior art manner wherein one end of the preform extended out of the riser 28 of the mold 20 and the other end extended out of the ingate 26.

Figure 4:
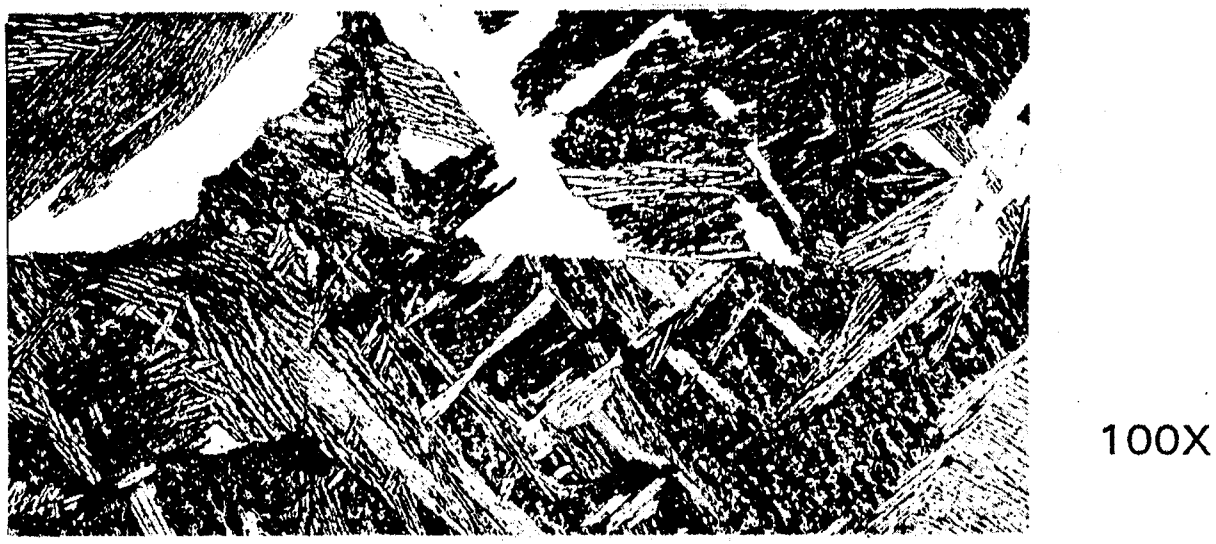
FIG. 4 is a photomicrograph of the bond region between the preformed insert and cast alloy in accordance with the invention.
Figure 5:
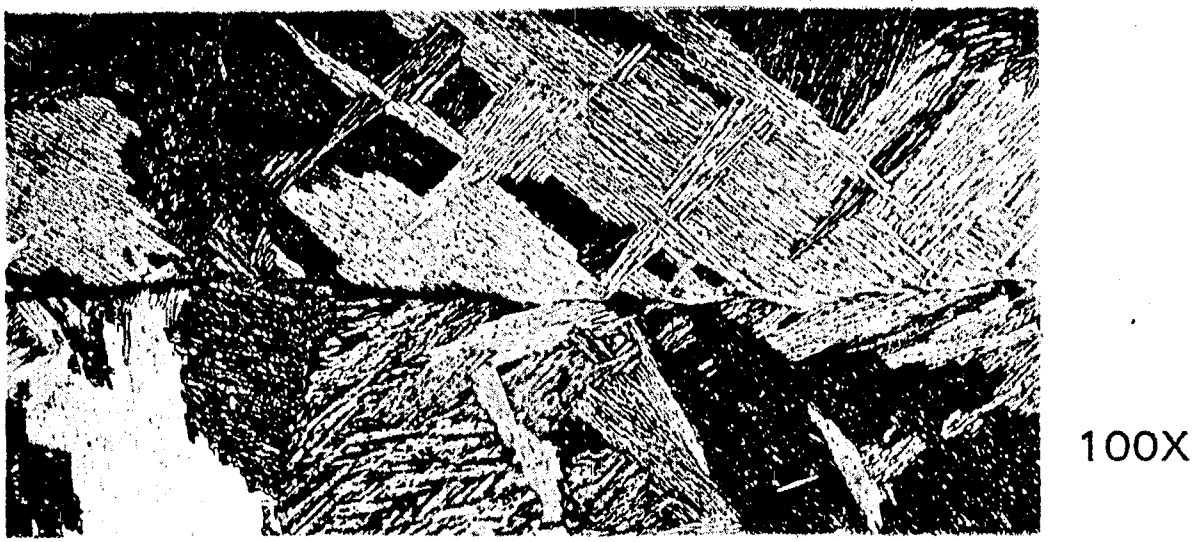
FIG. 5 PRIOR ART
FIG. 5 is a photomicrograph of the bond region between the preformed insert and cast alloy in accordance with the prior art.

A Ti-6Al-4V melt was cast under a vacuum of less than 10 microns into the mold preheated to 600° F. and solidified in each mold cavity. The plate-shaped castings were separated from the shell mold and identically hot isostatically pressed at 1650° F. and 15 ksi argon gas pressure for 2 hours. FIGS. 4 and 5 illustrate the microstructures of the bicastings in the bond region between the insert 12 and cast melt 52. It is evident from FIG. 4 that a sound, void-free bond is produced in the bicasting made in accordance with the invention. On the other hand, it is apparent from FIG. 5 that an unsound, void-containing bond was present in the bicasting made in accordance with the prior art.

EXAMPLE 3

A ceramic shell mold 20 similar to that shown in FIG. 2 was made in accordance with conventional shell mold practice. A Ti-6Al-4V/SiC fiber composite preformed insert 10 was made by RF plasma spraying a Ti-6Al-4V alloy onto SiC fibers and then vacuum hot pressing the sprayed mass to consolidate the insert 10. The insert was then positioned in a mold cavity having the shape of a generic missile fin in the manner shown in FIG. 2. The preformed insert measured 2 inches in width, 2 inches in vertical length, and 0.15 inch in thickness and was suspended in the mold cavity using first and second pairs of Ti-6Al-4V suspension pins 12,12' of 0.060 inch diameter and 3 inches length TIG welded to opposite ends of the plate insert as shown in FIG. 2. The other ends of the suspension pins were fixed in position on the mold 20 in the manner also shown in FIG. 2.

A Ti-6Al-4V melt was cast under a vacuum of less than 10 microns into the mold preheated to 600° F. and solidified in the mold cavity. The bicasting was separated from the shell mold and isostatically pressed at 1650° F. and 15 ksi argon gas pressure for 2 hours. Metallographic analysis concluded that the insert/cast melt bond was metallurgically sound due to substantial grain growth across the interface between the insert and cast melt.

From the above discussion, it is evident that the invention provides an improved bicasting type of process for making a composite casting wherein a sound, contamination-free, void-free bond is reliably and reproducibly produced between the preformed insert 10 and the cast melt 52 therearound. Moreover, at the same time, the invention provides an improved bicasting type of process wherein accurate positioning of the preformed insert in the mold cavity and thus in the final composite casting is achieved.

Although the invention has been described in detail above with respect to use of axially extending suspension members 12,12' affixed to opposite ends **10*a*,10*b* of the preformed insert 10, the invention is not so limited and may be practiced using slender suspension members that are instead fixed to the opposite lateral sides 10*c*,10*d*** *of the preformed insert* 10 and extend transversely (i.e., from the sides thereof) into suitable locating depressions or apertures in the upstanding mold cavity walls.

Moreover, while the invention has been described in terms of specific embodiments thereof, it is not intended to be limited thereto but rather only to the extent set forth in the following claims.

I claim:

1. A method of making a casting having a preformed reinforcement insert metallurgically bonded therein, comprising:

(a) providing a casting mold having a melt-receiving mold cavity, (b) suspending a preformed metallic or intermetallic reinforcement insert in the mold cavity by at least one elongated, slender suspension member fixed at one end to the insert and engaging the mold at another end, (c) introducing a melt into the mold cavity about the suspended insert and about at least a portion of the suspension member, (d) solidifying the melt in the mold cavity to provide a casting of said solidified melt having said insert and said suspension member disposed therein, and (e) subjecting the casting having said insert and said suspension member disposed therein to elevated temperature and isostatic gas pressure conditions wherein said slender suspension member formed with said solidified melt an interface therebetween effective to inhibit gas penetration between said insert and solidified melt so that a sound, void-free, contamination-free metallurgical bond is formed between said insert and said solidified melt by said elevated temperature and isostatic gas pressure.

2. The method of claim 1 including providing the suspension member with a cross-section substantially less than the cross-section of said preformed insert to provide a reduced-area interface between the suspension member and the cast melt effective to inhibit gas penetration between the insert and the solidified melt.

3. The method of claim 2 wherein the ratio of the cross-section of the suspension member to the cross-section of the preformed insert is in the range of about 0.002 to about 0.1.

4. The method of claim 1 wherein the suspension member is at least partially metallurgically bonded to the cast melt to inhibit penetration of the elevated isostatic gas pressure between the preformed insert and the solidified melt.

5. The method of claim 4 wherein the suspension member is partially melted by the melt introduced into the mold to enhance said metallurgical bonding.

6. The method of claim 5 wherein the suspension member includes a melting point depressant to enhance bonding between the cast melt and the suspension member.

7. The method of claim 1 wherein said another end of the suspension member is received in an ingate passage of the mold that supplies the melt to the mold cavity and is fixed in position therein so as to locate the insert in preselected position in the . mold cavity.

8. The method of claim 1 wherein said another end of the suspension member is received in a riser passage of the mold and is fixed in position therein so as to locate the insert in preselected position in the mold cavity.

9. The method of claim 1 wherein the suspension member comprises an elongated pin.

10. The method of claim 1 wherein the preformed insert comprised a metallic or intermetallic material that corresponds in composition to the melt introduced into the mold cavity.

11. The method of claim 10 wherein the metallic or intermetallic material of the insert includes reinforcements therein.

12. The method of claim 11 wherein the reinforcements comprise reinforcing filaments.

13. A method of making a casting having a reinforcement insert metallurgically bonded therein, comprising:

(a) providing a ceramic investment casting mold having a melt-receiving mold cavity, (b) suspending a preformed metallic or intermetallic reinforcement insert in the mold cavity by at least one elongated, slender suspension member fixed at one end to the insert and engaging the mold at another end, (c) introducing a melt into the mold cavity about the insert and about at least a portion of the suspension member, (d) solidifying the melt in the mold cavity to provide a casting of the solidified melt having said insert and said suspension member disposed therein, and (e) subjecting the casting having said insert and said suspension member disposed therein to elevated temperature and isostatic gas pressure conditions wherein said slender suspension member forms with the solidified melt an interface therebetween effective to inhibit gas penetration between the preformed insert and the solidified melt so that a sound, void-free, contamination-free metallurgical bond is formed between said insert and said solidified melt by said elevated temperature and isostatic gas pressure.

14. The method of claim 13 including providing the suspension member with a cross-section substantially less than the cross-section of said preformed insert to provide a reduced-area interface effective to inhibit gas penetration between the insert and the solidified melt therearound.

15. The method of claim 14 wherein the ratio of the cross-section of the suspension member to the cross-section of the preformed insert is in the range of about 0.002 to about 0.1.

16. The method of claim 13 wherein the suspension member is at least partially metallurgically bonded to the cast melt to inhibit penetration of the elevated isostatic gas pressure between the preformed insert and the solidified melt therearound.

17. The method of claim 16 wherein the suspension member is partially melted by the melt introduced into the mold to enhance said metallurgical bonding.

18. The method of claim 17 wherein the suspension member includes a melting point depressant to enhance bonding between the cast melt and the suspension member.

19. The method of claim 13 wherein said another end of the suspension member is received in an ingate of the mold that supplies the melt to the mold cavity and is connected to the mold therein so as to locate the insert in preselected position in the mold cavity.

20. The method of claim 13 wherein said another end of the suspension member is received in a riser portion of the mold disposed above the mold cavity and is connected to the mold therein so as to locate the insert in preselected position in the mold cavity.

21. The method of claim 13 wherein the suspension member comprises an elongated pin.

22. The method of clam 13 wherein the reinforcement insert comprises a metallic or intermetallic material corresponding in composition to the melt introduced into the mold cavity.

23. The method of claim 22 wherein the metallic or intermetallic material includes reinforcements therein.

24. The method of claim 1 wherein said suspension member comprises a metallic or intermetallic material.

25. The method of claim 13 wherein said suspension member comprises a metallic or intermetallic material.

* * * * *

UNITED STATES PATENT AND TRADEMARK OFFICE

CERTIFICATE OF CORRECTION

PATENT NO. : 5 241 738

DATED : September 7, 1993

INVENTOR(S) : Gregory N. COLVIN

It is certified that error appears in the above-identified patent and that said Letters Patent is hereby corrected as shown below:

Column 8, line 40; replace "formed" with ---forms---.

Column 9, line 14; replace "comprised" with ---comprises---.

Signed and Sealed this

Twenty-second Day of March, 1994

*Attest:*

Bruce Lehman

BRUCE LEHMAN

*Attesting Officer*

*Commissioner of Patents and Trademarks*